US005479667A

United States Patent [19]

Nelson et al.

[11] Patent Number: 5,479,667

[45] Date of Patent: Jan. 2, 1996

[54] ERGONOMIC PILLOW ASSEMBLY

[76] Inventors: Frank O. Nelson; Kathy L. Nelson, both of 91 Harvest Pl., Woodland Park, Colo. 80863

[21] Appl. No.: 197,266

[22] Filed: Feb. 16, 1994

[51] Int. Cl.[6] ..... A47C 20/02

[52] U.S. Cl. ..... 5/636; 5/632; 5/639; 5/645; 5/904

[58] Field of Search ..... 5/632, 633, 636, 5/639, 645, 904, 630, 622, 648; 128/845

[56] References Cited

U.S. PATENT DOCUMENTS

| | | | |
|---|---|---|---|
| 2,099,977 | 11/1937 | Harris | 5/630 X |
| 2,700,779 | 2/1955 | Tolkowsky | 5/636 X |
| 2,782,427 | 2/1957 | Ericson | 5/632 |
| 3,243,828 | 4/1966 | McCarty | 5/636 |
| 3,384,719 | 5/1968 | Lanzara | 5/904 X |
| 3,648,308 | 3/1972 | Greenawalt | 5/632 |
| 4,074,376 | 2/1978 | Bond | 5/632 |
| 4,850,067 | 7/1989 | Latorre | 5/636 |

FOREIGN PATENT DOCUMENTS

| | | | |
|---|---|---|---|
| 6602361 | 2/1965 | Netherlands | 5/904 |

*Primary Examiner*—Michael F. Trettel
*Attorney, Agent, or Firm*—Phillip A. Rein

[57] ABSTRACT

An ergonomic pillow assembly utilized to provide relaxing comfort and rest to a person having an upper torso problem with pain through the head, neck, and spinal assembly. The ergonomic pillow assembly includes 1) a head support assembly; 2) a thoracic support assembly connected to the head support assembly; 3) a waist and lumbar support assembly connected to the thoracic support assembly; and 4) an audio transmitter assembly to provide audio sound to the users thereof. The head support assembly includes 1) a head support member; 2) a side cervical support member; and 3) a rear cervical support member operable to provide the proper support to a skull member of the user thereof. The thoracic support assembly includes 1) a thoracic support member; 2) a thoracic cage retainer member; and 3) a shoulder cut-out and retainer area operable to receive a shoulder portion of the user thereof. The waist and lumbar support assembly includes a waist support member and a lumbar support member operable to hold the waist and lumbar portion of a user thereof in a neutral and comfortable support position. The audio transmitter assembly includes a speaker resonating chamber in the head support member operable to receive a pair of stereo speaker members therein.

22 Claims, 4 Drawing Sheets

49
14
36
6
12
5
39
105
92
49
94
70

49
6
14
16
64

ERGONOMIC PILLOW ASSEMBLY

PRIOR ART

This invention relates to an ergonomic pillow assembly for sleeping or relaxation of a person utilizing same which includes an improved sound system for the promotion of relaxation and accommodation for sleeping on either the right or left side or on the back.

A patent search revealed the following United States patents:

| U.S. Pat. No. | Inventor |
|---|---|
| 1,045,228 | Weltmer |
| 3,626,526 | Viel |
| 4,218,792 | Kogan |
| 4,441,221 | Enste et al |
| 4,550,458 | Fiore |
| 4,635,306 | Willey |
| 4,876,755 | Parrish |
| 4,901,384 | Eary |
| 4,996,734 | Rowe |
| 5,123,133 | Albert |

The Weltmer patent discloses pads for use in conjunction with mattresses.

The Albert patent discloses a combined support of the head with sound emitting devices which can provide music or sounds of a relaxing nature.

The Viel patent discloses a compound, multi-layered mattress formed with a plurality of cut-outs from a base layer joined to one horizontal surface of the base layer.

The Enste et al and Willey patents disclose supports and other cushions which are dedicated principally to engaging the front or reverse of a user's torso while the user remains in a sitting or partially reclining position.

The Kogan and Fiore patents disclose complex forms which are molded to conform to the head and cervical portions of the user's body.

The Parrish patent discloses an array of semi-cylindrical pillows which provide for the support of cervical, thoracic, and lumbar regions of a user's body by attaching them in various configurations for different body positions.

The Eary patent discloses a body pillow which attempts to position the user's spine in a natural position while sleeping on one side.

The Rowe patent discloses a pillow incorporating various levels of firmness to support the head and neck with an accommodation of persons wearing orthodontic headgear.

While these and other examples of the pillow, cushion, and support arts enable a user to remain in one or more positions with varying degrees of comfort, none of them address the alignment of the entire spine and the head in both side and back sleeping positions. They do not allow sufficient freedom of the user to change positions from left to right to back without reconfiguration of the pillow, cushions, or mattresses, or without being restricted to one or the other position. None of the prior art references combine relaxing music or sound with complete spinal support for the most common sleeping postures.

PREFERRED EMBODIMENT OF THE INVENTION

In one preferred embodiment of this invention, an ergonomic pillow assembly is provided which may be of one-piece construction or formed in separate elements joined together by various means including the use of adhesives.

The ergonomic pillow assembly includes 1) a head support assembly; 2) a thoracic support assembly integral with the head support assembly; 3) a waist and lumbar support assembly integral with the thoracic support assembly; and 4) an audio transmitter assembly mounted on the head support assembly.

The head support assembly includes an elevated head support member and a rear cervical support member. The head support member is used to support rear and side portions of a user's head thereon.

The side cervical support member is used to support jaw and cheek portions of the user's head thereon.

The rear cervical support member is used to support a neck portion of the user thereon.

The thoracic support assembly includes 1) a thoracic support member; 2) a thoracic cage retainer member; and 3) a shoulder cut-out retainer area. The thoracic support member inclines downwardly from and integral with the rear cervical support member.

The thoracic cage retainer member extends upwardly and outwardly of the thoracic support member and acts to retain the user's body on the ergonomic pillow assembly.

The shoulder cut-out retainer area is positioned on both sides of the thoracic support member and acts to receive a respective one of the user's shoulder therein when resting on one's left or right side.

The waist and lumbar support assembly includes 1) a waist support member; and 2) a lumbar support member.

The waist support member includes an arcuate waist support surface of a concave shape first extended upwardly from its connection to the thoracic support member and then extended downwardly to a support member having the ergonomic pillow assembly mounted thereon.

The lumbar support member includes an arcuate lumbar support surface to receive and support the user's lumbar section or lower back thereon.

The audio transmitter assembly includes 1) a pair of stereo speaker members mounted within speaker resonating chambers in the head support assembly; 2) an audio source member, such as a compact disc player, radio, etc., operably connected to the stereo speaker members; and 3) an audio control assembly mounted between the stereo speaker members and the audio source member. The audio control assembly is operable in a conventional manner to control audio sounds to the stereo speaker members through a timer circuit, on-off switch, and volume controls.

A second embodiment of this invention is a dual ergonomic pillow assembly for conjoint use by two (2) user's and substantially similar to joining together two (2) of the ergonomic pillow assemblies described above.

OBJECTS OF THE INVENTION

One object of this invention is to provide an ergonomic pillow assembly with which a neutral spine alignment can be maintained while sleeping on either the back or the side of a user to provide 1) a support which disperses the weight of an upper torso of a user away from the shoulder and equally toward other skeletal structures while sleeping on one's side; and 2) a spinal support which accommodates a complex curvature of the user's neutral aligned spine while sleeping on one's back while distributing body weight equally over contacting surfaces of the body. By maintaining one's spine assembly in a neutral position while sleeping or reclining on one's back or side, this ergonomic pillow assembly maintains advantages over prior art which only supports a cervical region of the user's body.

Another object of this invention is to provide an ergonomic pillow assembly which provides support necessary to the user's spine assembly, namely, in cervical, thoracic, and lumbar sections to prevent the spine assembly from flexing to the right or left while one is reclining on either the right or left side. The cervical section of the spine assembly is that group of seven (7) vertebrae extending from the base of a skull to the top of the rib cage, commonly referred to as the neck. The thoracic section of the spine assembly is that group of twelve (12) vertebrae extending down from the cervical section to approximately the bottom of the rib cage, commonly referred to as the upper back. The lumbar section of the spine assembly is that group of five (5) vertebrae extending down from the thoracic section of the spine assembly to the sacrum, commonly referred to as the lower back.

One other object of this invention is to provide an ergonomic pillow assembly allowing for ample range of motion of the user's lower arm and shoulder while sleeping or reclining on one's side by ensuring that no part of the ergonomic pillow assembly impedes a reasonable shoulder or arm angle with respect to the user's body.

One further object of this invention is to provide an ergonomic pillow assembly including 1) a head retaining section to prevent the user's head from rolling off either side of the ergonomic pillow assembly; 2) a thoracic cage retainer member to retain the user's thoracic cage; and 3) a shoulder cut-off retainer area providing containment for the user's shoulder while sleeping on either side.

Another further object of this invention is to provide an ergonomic pillow assembly which allows for the freedom of motion common with a sleeping person with the ability to switch between a face down, back, and side resting positions without the need to reconfigure the ergonomic pillow assembly.

An additional object of this invention is to provide an ergonomic pillow assembly which eliminates problems associated with conventional pillows which move out of position as a user changes positions while sleeping. The ergonomic pillow assembly of this invention has the advantage of remaining in place since the user's entire torso is supported on top of the ergonomic pillow assembly.

Another object of the ergonomic pillow assembly of this invention is that the design is simple with no moving parts or sections which must be reconfigured to obtain the complete utility thereof.

Another specific object of the ergonomic pillow assembly of this invention is to allow the user thereof to hear music or relaxation sounds emanating from stereo speaker members clearly regardless of whether the user is in a face down, side, or back resting position.

Another object of the ergonomic pillow assembly of this invention is to provide an environment in which relaxation and sleep are promoted through a combination of ergonomic support for the user's head and spine assembly and the use of relaxing sounds such as ocean waves, babbling brooks, chirping birds, etc. working together to relax the user's muscles of the neck and back areas.

Another object of this invention is to provide an ergonomic pillow assembly constructed of a resilient foam or of an inflatable and flexible bladder that allows for a reasonable range of differences in the user's body dimensions or spinal curvature.

One further object of this invention is to provide an ergonomic pillow assembly that would be manufactured in three or four sizes to accommodate people of different ages and heights plus custom designed ergonomic pillow assemblies could be manufactured for people 1) of unusual dimensions; 2) having severe spinal curvature problems; and 3) to exact shoulder width and spine length dimensions for maximum comfort.

Another object of this invention is to provide a dual ergonomic pillow assembly with two (2) of the ergonomic pillow assemblies interconnected and usable by two (2) people with the same object and advantages as noted above for the single ergonomic pillow assembly.

Still, one other object of this invention is to provide an ergonomic pillow assembly that is economical to manufacture; simple to use; providing soothing, relaxing sounds to the user thereof; achieving the ideal support to the user's torso; and substantially maintenance free.

Various other objects, advantages, and features of this invention will become apparent to those skilled in the art from the following discussion, taken in conjunction with the accompanying drawings, in which:

FIGURES OF THE INVENTION

Figure 1:
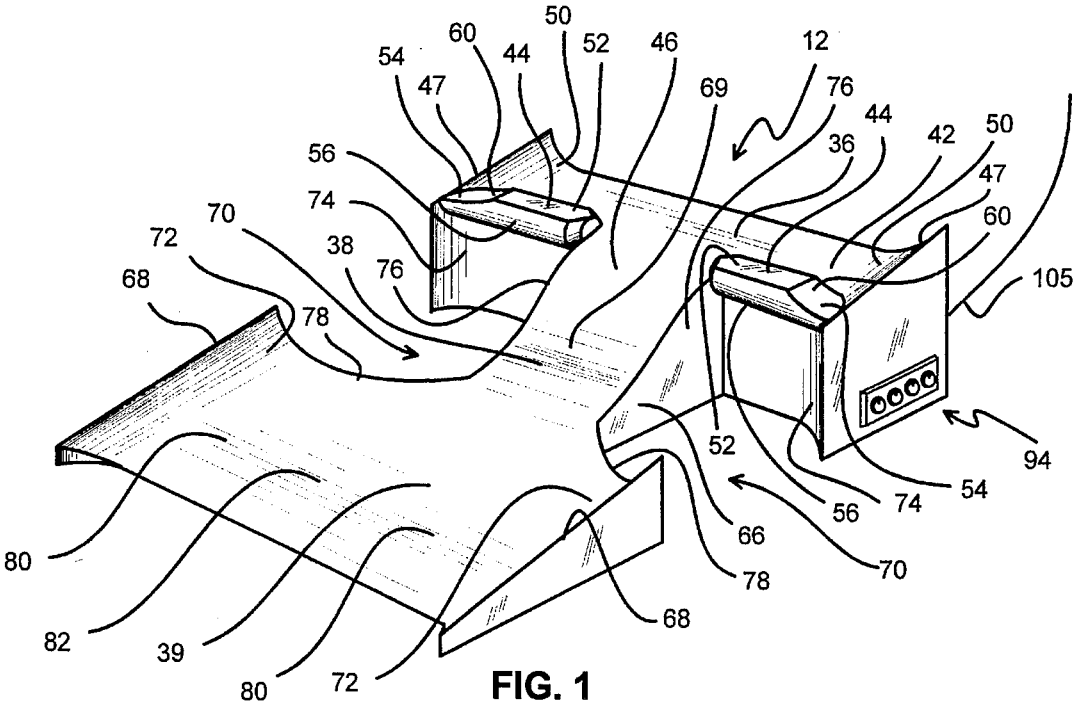
FIG. 1 is a perspective view of the ergonomic pillow assembly of this invention.

The following is a discussion and description of preferred specific embodiments of the ergonomic pillow assembly and the dual ergonomic pillow assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail, and in particular to FIG. 1, an ergonomic pillow assembly of this invention, indicated generally at 12, is utilized by a user or relaxing person 14 while resting or sleeping thereon.

Figure 8:
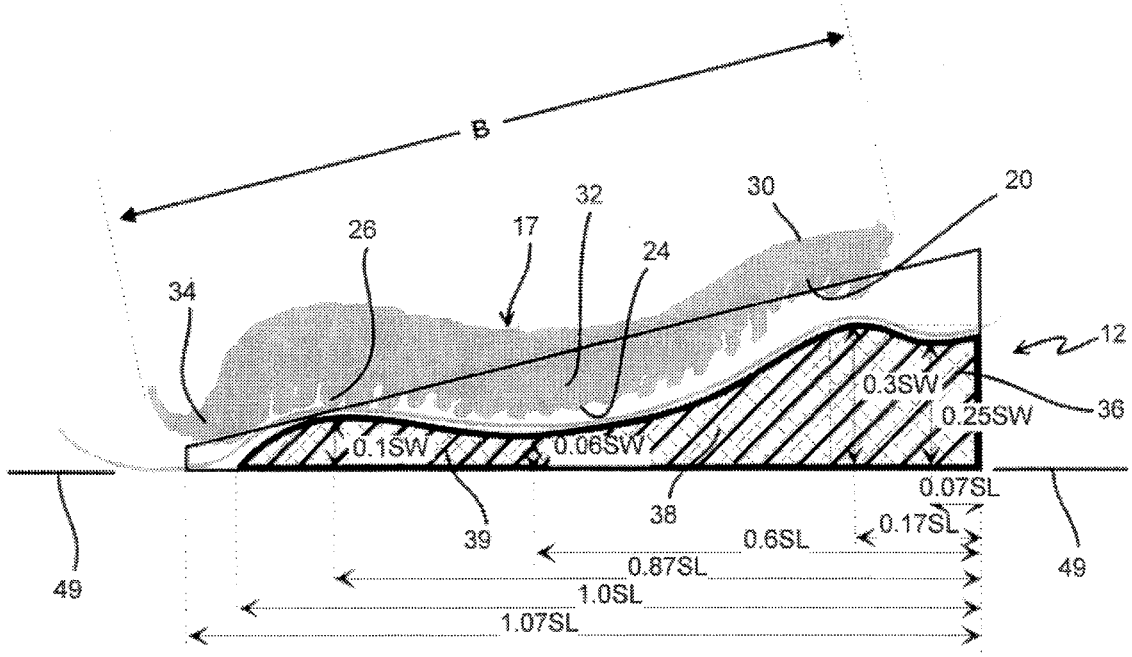
FIG. 8 is an enlarged sectional view similar to FIG. 5 illustrating relative width and height size relationships in regard to shoulder width and spine length of the user thereof.

As will be discussed herein, the relaxing person 14 in this particular testing environment is taken to have a shoulder width indicated by the letter "A" (FIG. 9) and a spinal length indicated by the letter "B" (FIG. 8).

Figure 9:
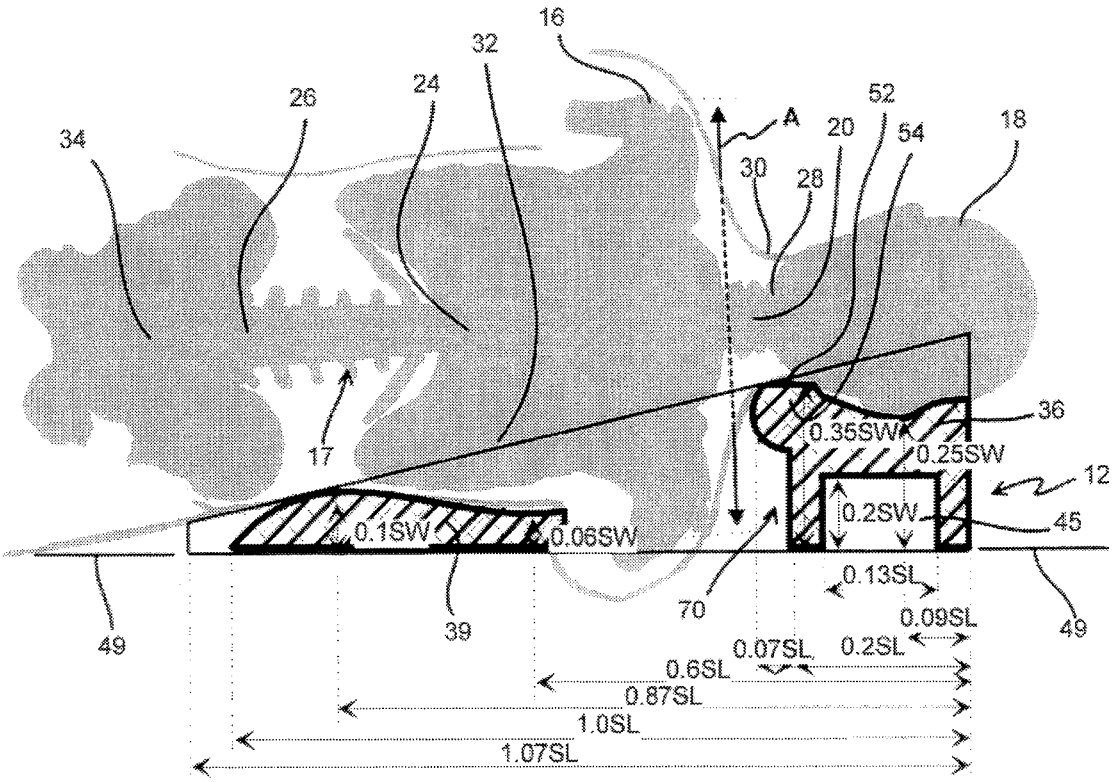
FIG. 9 is an enlarged sectional view similar to FIG. 6 illustrating relative width and height size relationships in regard to shoulder width and spine length of the user thereof.

A person's skeleton 16 is noted in FIG. 9 as having 1) a skull section 18; 2) a cervical section 20; 3) a thoracic section 24; and 4) a lumbar section 26 which are joined together to form a person's spinal assembly 17.

The skull section 18 has a base skull portion 28 which is connected to the cervical section 20 and, more particularly, to a neck portion 30. The neck portion 30 is referred to as a a person's "neck" and comprises seven (7) vertebrae extending from the base skull portion 28 to the top of the person's rib cage.

The thoracic section 24 has twelve (12) vertebrae extending down from the cervical section 20 of the person's spine assembly 17 to approximately an end bottom of a bottom rib cage portion 32. This area is commonly referred to as the "upper back".

The lumbar section 26 of the person's spinal assembly 17 is a group of five (5) vertebrae extended downwardly from the thoracic section 24 to a sacrum portion 34, commonly referred to as the "lower back".

On referring to FIG. 1, the ergonomic pillow assembly 12 includes a head support assembly 36 which is connected or integrally formed with a thoracic support section 38 which, in turn, includes a waist and lumbar support assembly 39 connected to or integrally formed with the thoracic support section 38, and an audio transmitter assembly 40 which is mounted in portions of the head support assembly 36.

Figure 6:
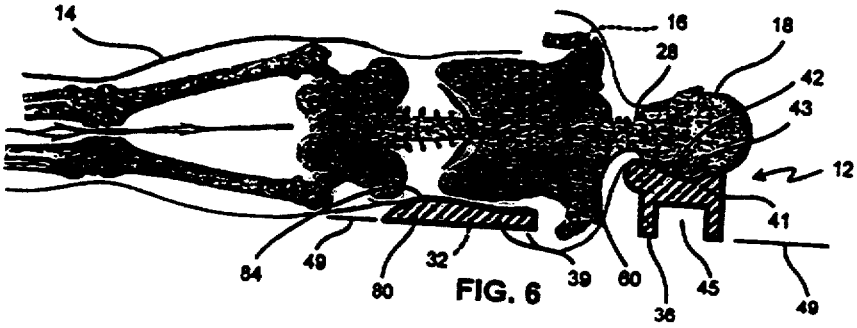
FIG. 6 is a cross sectional view taken along line 6—6 in FIG. 4.

As noted in FIG. 6, the head support assembly 36 includes a head support section 41 and a head retainer section 47 (FIG. 1). The head support section 41 is adapted to rest on a bed support surface 49 and having an upper arcuate surface 43 to receive and support the skull portion 18 of the relaxing person 14. Further, the head support section 41 includes a pair of spaced speaker resonating chambers 45 for reasons to be explained.

The head retainer section 47 includes an outer arcuate retainer portion 50 extended and curved upwardly from the head support section 41.

As shown in FIG. 1, the side cervical support members 44 include a neck support section 52 integral with a jaw support section 54. The neck support section 52 has an elevated body portion 56 to receive the cervical section 20 of the person 14 thereagainst when in the left side relaxing position as noted in FIG. 4.

At this time, the jaw support section 54 has an arcuate support surface 60 on which the jaw of the relaxing person 14 is being received and rested (FIG. 6).

Figure 5:
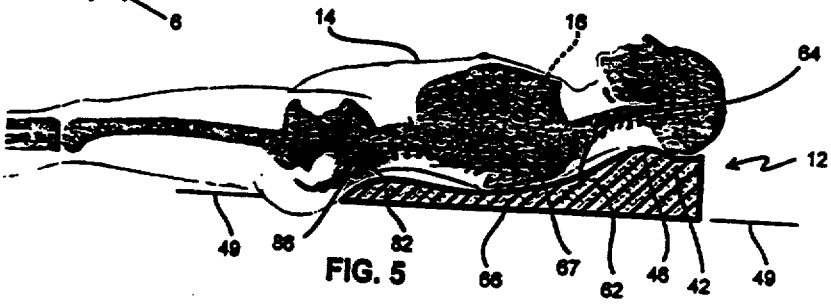
FIG. 5 is a cross sectional view taken along line 5—5 in FIG. 3.

As noted in FIG. 5, the rear cervical support member 46 includes a cervical support body 62 having an upper arcuate inclined support surface 64. The rear cervical support member 46 with the support surface 64 is inclined downwardly from its attachment to the head support member 42.

The thoracic support member 66 has an upper arcuate downwardly inclined thoracic support surface 67 connected to or integrally formed with the head support assembly 36 to form a thoracic cage support area 69.

Figures 3, 4:
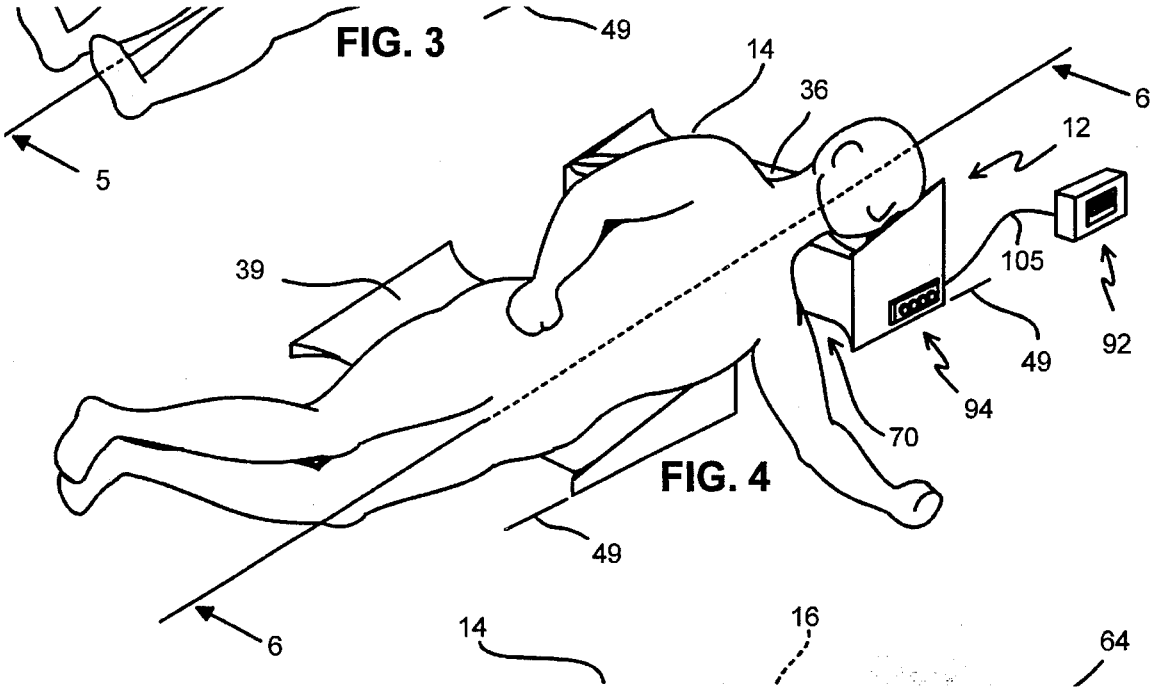
FIG. 3 is a perspective view of the ergonomic pillow assembly showing use by a person while reclining on one's back.
FIG. 4 is a perspective view similar to FIG. 3 of the ergonomic pillow assembly showing use by a person while reclining on one's left side.

The thoracic cage retainer member 68 is provided with an arcuate upward retainer surface 72 which operates to contact the rib cage of the person's skeleton 16 as noted in FIG. 4 to act as a body retainer.

The shoulder cut-out retainer area 70 is operable to receive the shoulder and arm area of a person's skeleton 16 therein when sleeping on one's side as noted in FIG. 4. The shoulder cut-out retainer area 70 is provided on each side of the thoracic support member 66 with a front wall section 74, a side wall section 76, and a back wall section 78.

The waist and lumbar support assembly 39 includes a waist support section 80, as shown in FIG. 6, and a lumbar support section 82 as shown in FIG. 5. The waist support section 80 is provided with an upper arcuate waist support surface 84 of concave shape to receive and support a waist portion of the person 14 thereof whether in a back or side rest position as noted in FIGS. 5 and 6.

As noted in FIG. 5, the lumbar support section 82 is provided with an arcuate lumbar support surface 86 to receive and support the lumbar support section 26 of the user 14 thereof.

Figure 2:
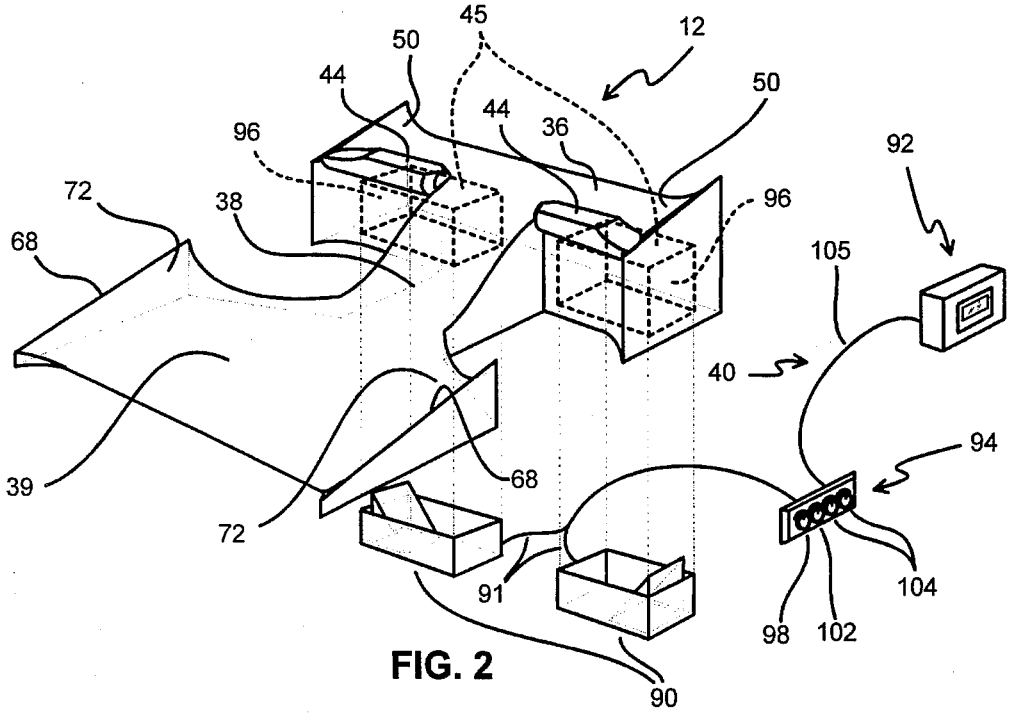
FIG. 2 is an exploded transparent perspective view of the ergonomic pillow assembly with broken lines showing location of speaker resonating chambers and stereo speaker members which are to be placed in the subject speaker resonating chambers.

As noted in FIG. 2, the audio transmitter assembly 40 includes 1) a pair of spaced speaker resonating chambers 45; 2) a pair of stereo speaker members 90; 3) an audio source member 92; and 4) an audio control assembly 94 operably connected between the stereo speaker members 90 and the audio source member 92.

The spaced speaker resonating chambers 45 are each rectangular cut-out openings 96 within the head support assembly 36 to receive a respective one of the stereo speaker members 90 therein. Each stereo speaker member 90 is provided with a speaker connector cord 91 extended therefrom and connected to the audio control assembly 94.

The audio control assembly 94 is provided with 1) an integrated on/off and volume switch 98; 2) sound quality control switches 104 for base and treble sounds; 3) a stereo balance control 102 connected individually and respectively to each of the stereo speaker members 90; and 3) a source connection cord 105 for connecting the audio control assembly 94 to the audio source member 92.

The audio source member 92 can be of various types of sound reproduction systems, such as a tape player, compact disc player, or radio/clock, etc. connected to the audio control assembly 94 by the source connection cord 105.

The sound control by the audio control assembly 94 is independently transferred through the speaker connector cord 91 to the respective stereo speaker members 90.

Figure 10:
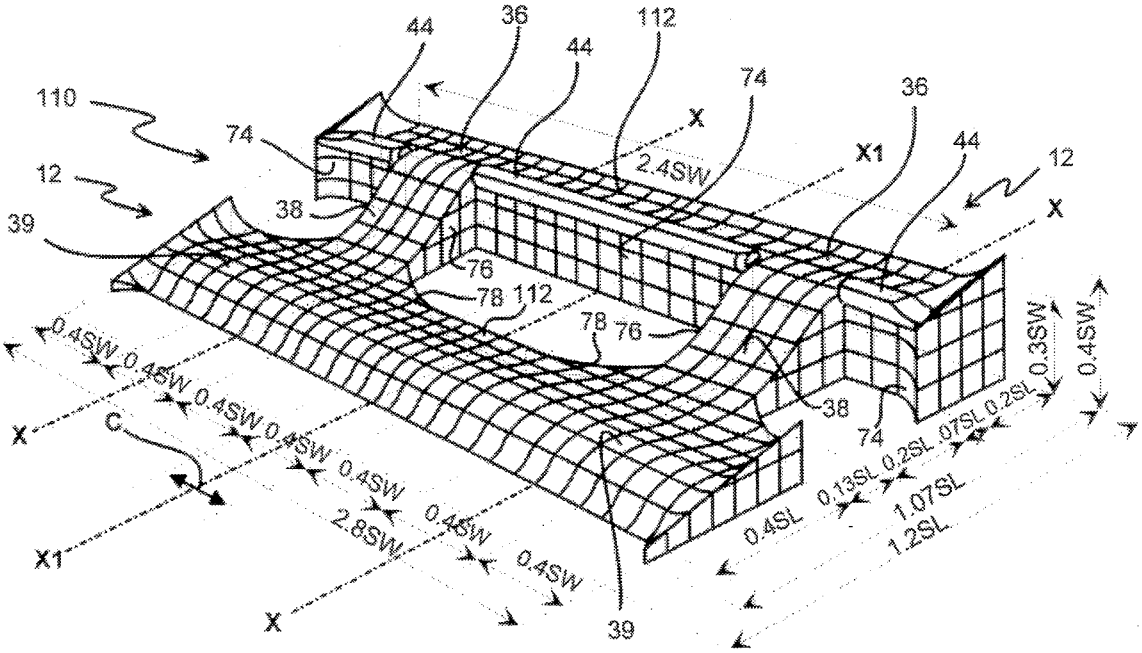
FIG. 10 is a perspective view similar to FIG. 7 of a second embodiment of this invention being a dual ergonomic pillow assembly.
Figure 3:
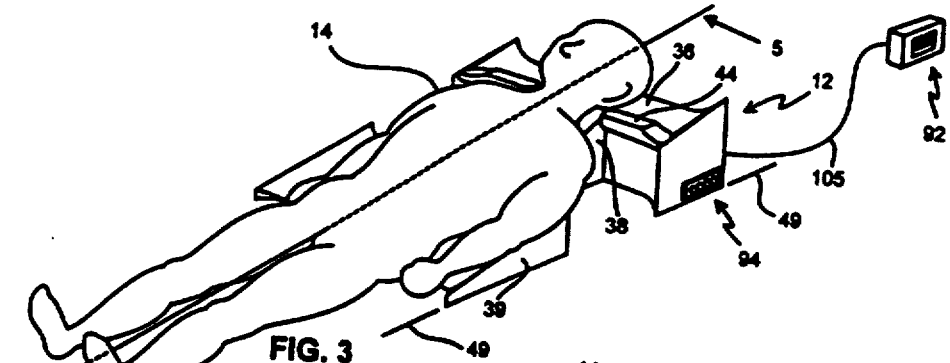
Figure 4:
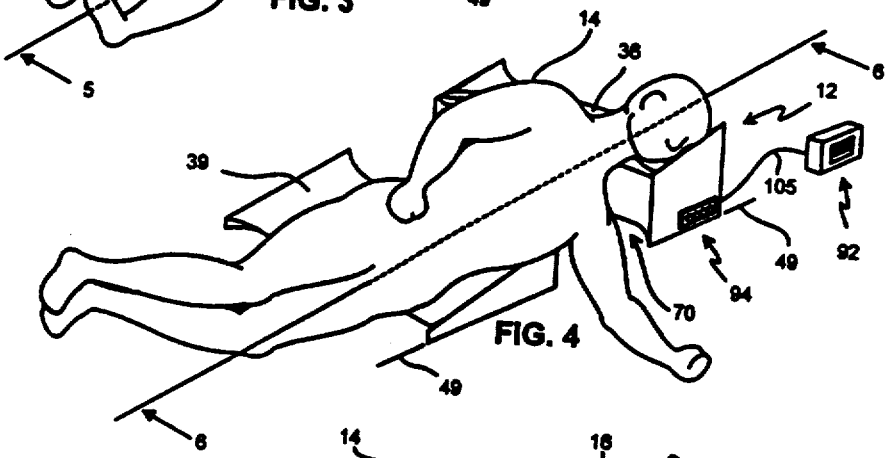

As shown in FIG. 10, a second embodiment of the invention is a dual ergonomic pillow assembly 110 for use by a pair of relaxing persons 14 to be supported on a queen or king size bed. The dual ergonomic pillow assembly 110 is basically constructed of an interconnected pair of the ergonomic pillow assemblies 12 joined at adjacent side wall portions with a central support section 112.

As noted in FIG. 10, each ergonomic pillow assembly 12 has a central longitudinal axis indicated by a line X—X which conforms to an identical longitudinal axis in the ergonomic pillow assembly 12 as noted in FIG. 1.

The central axis of the dual ergonomic pillow assembly 110 is noted by the line X1—X1 in FIG. 10. In this area, it is noted that the arcuate head retainer sections 47 and the thoracic cage retainer members 68 in the center portion of the interconnected ergonomic pillow assemblies 12 have been removed.

Another modification of the dual ergonomic pillow assembly 110 is wherein an elongated central side cervical support member 44 extends between the spaced ones of the ergonomic pillow assemblies 12.

Figure 7:
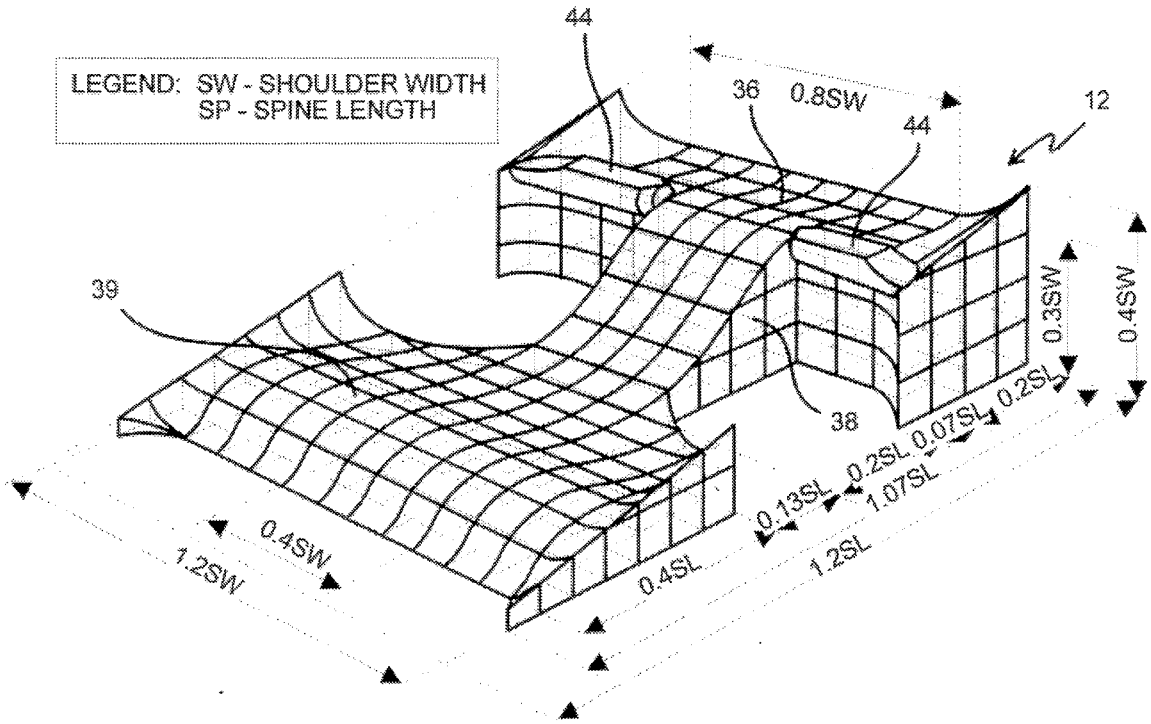
FIG. 7 is a perspective view of the ergonomic pillow assembly divided into increment blocks of relative sizes in regard to shoulder width and spine length of the user thereof.

On referring to FIG. 7, the ergonomic pillow assembly 12 has been custom constructed for a relaxing person 14 having a shoulder width, referred to as "SW", of 20 inches and a spine length, referred to as "SL", of 30 inches. The relationship of the shoulder width and the spine length relative to the ergonomic pillow assembly 12 is shown to achieve various slopes and curves of ideal configuration therein which is important to the resultant comfort of the relaxing person 14.

The length of the ergonomic pillow assembly 12 is 1.07 SL and the width is 1.2 SW. On translating, the length thereof is 1.07 SL×30 which is 32.1 inches and the width is 1.2 SW×20 or 24 inches. This allows sufficient clearance for the relaxing person 14 having the shoulder width of 20 inches and spinal length of 30 inches.

FIG. 8 shows size relationships in regard to shoulder width and spine length to ideally support a person's spinal assembly 17 when relaxing on one's back position as noted in FIGS. 3 and 5.

The various arcuate curves as described in FIGS. 7, 8, 9, and 10, being a combination of concave and convex curves, produces the most satisfactory result when the relaxing person 14 is utilizing the ergonomic pillow assembly 12.

Medical evidence indicates that, when the spinal assembly 17 of a relaxing person 14 is held and supported in the condition as noted in FIG. 8, this provides the most soothing, relaxing, and least pressure on the spinal assembly 17 which results in the relaxation of the person 14 utilizing the ergonomic pillow assembly 12.

A second position of the relaxing person 14 is to lie on either the left side, as noted in FIG. 4, or on the right side being opposite therefrom but having the same relaxing and soothing effects. This left side relaxing position is noted in FIGS. 4, 6, and 9 which shows the support given to the neck portion 30, bottom rib cage portion 32, and sacrum portion 34 of the relaxing person 14, including a waist portion.

As noted in FIG. 9, the retainer area 70 is operable to receive a shoulder portion of the relaxing person 14 therein without applying any undue pressures against the spinal assembly 17 of the relaxing person 14 which would normally cause pain and discomfort.

On referring to FIG. 1, the head support assembly 36 with the side cervical support member 44 with the neck support section 52 and the jaw support section 54 provides substantial support to the skull section 18 of the relaxing person 14.

Further, the size, height, length, and width relative relationships of the ergonomic pillow assembly 12, as shown in FIGS. 6, 9 and 5, 8, provides the most relaxing support to the spinal assembly 17 of a relaxing person 14 to achieve the new and novel feature of this invention.

USE AND OPERATION OF THE INVENTION

In the use and operation of the ergonomic pillow assembly 12 of this invention, the ergonomic pillow assembly 12 is to be placed on a support surface, normally a bed mattress, as indicated by a bed surface 49. The ergonomic pillow assembly 12 can be covered with a sheet-like material being of a close fit and removable for laundering purposes.

The manner of usage of the ergonomic pillow assembly 12 is shown in FIGS. 3 and 4 wherein 1) FIG. 3 illustrates the relaxing person 14 in a reclining, face-up position; 2) FIG. 4 indicates use when the relaxing person 14 is lying on its left side; and 4) the relaxing person 14 could be in a face-down position (not shown).

The usage described herein for the relaxing person 14 lying on its right side would be opposite that disclosed in FIGS. 4 and 6 on residing on one's left side.

As noted in FIG. 3, the back lying positions place the head of the relaxing person 14 in the center of the head support assembly 36 with the relaxing person 14 having the person's spinal assembly 17 aligned along a central longitudinal axis of the ergonomic pillow assembly 12.

In this way, the neck of the relaxing person 14 is supported by the rear cervical support member 46; the upper back of the relaxing person 14 is supported by the thoracic support assembly 38; and the lower back of the relaxing person 14 is supported by the waist and lumbar support assembly 39.

In the support position as noted in FIG. 3, no support is provided for the shoulders of the relaxing person 14 and the arms of the relaxing person 14 may lay beside its torso supported by the waist support section 80.

The arms of the relaxing person 14 may be positioned away from its torso laying in the area between the head support assembly 36 and the waist and lumbar support assembly 39 being supported by the bed mattress surface 49 under the ergonomic pillow assembly 12 and being contained by the shoulder cut-out retainer area 70.

In regard to FIG. 6 which shows the relaxing person 14 reclining in a face left position, this side laying position places the skull section 18 of the relaxing person 14 on the end of the head support member 42 which is to the user's left side.

The side cervical support members 44 support the neck area of the relaxing person 14. The side cervical support members 44 include the neck support section 52 to provide support to the subject neck and the jaw support section 54 and supports the side of the face and jaw areas of the relaxing person 14.

The head retainer section 47 of the head support member 42 maintains contact with a left side of the head portion of the relaxing person 14 to provide support thereto. This particular support begins on the left cheek of the relaxing person 14 and extends up to its eyebrow and forehead. Thus, the head retainer section 47 prevents the head of the relaxing person 14 from rolling off the head support member 42 while keeping the air passages of the nose and mouth free from obstructions.

In the condition of FIG. 4, the left shoulder of the relaxing person 14 extends downwardly into the shoulder cut-out retainer area 70. In this left side face left position, the left arm of the relaxing person 14 rests on the bed surface 49 which supports the ergonomic pillow assembly 12. In this position, the rib cage of the relaxing person 14 is supported by the thoracic cage retainer member 68 and the waist and lumbar assembly 39 (FIG. 1). The relaxing person 14 has its rib cage making contact with the thoracic cage retainer member 68 signaling the relaxing person 14 where the left edge of its torso support is located.

The right arm of the relaxing person 14 can lay on the side of its body as illustrated in FIG. 4 or, alternatively, a standard pillow member can be placed in front of the chest of a shoulder portion of the relaxing person 14 whereupon the right arm can rest upon it.

The use of the ergonomic pillow assembly 12 with the relaxing person 14 in a face right position is identical to the usage described above for the left face position except that all indications of right and left are reversed.

The relaxing person 14 may rotate between left facing, right facing, up facing, or face down positions through use of its legs and feet and through a normal twisting motion of the shoulders and hips.

Prior to reclining on the ergonomic pillow assembly 12, the relaxing person 14 attaches the audio transmitter assembly 40 through an audio source member 92 to a standard electrical power source. The audio control assembly 94 is energized through the integrated on/off and volume switch 98 and the stereo balance control 102 is adjusted to regular stereo speaker members 90 to energize as desired.

The audio control assembly 94 has a stereo balance control 102 connected independently and respectively to the stereo speaker members 90. The volume to be achieved from the audio source member 92 is controlled through the integrated on/off and volume control switch 98 to the desires of the relaxing person 14.

For use of the dual ergonomic pillow assembly 110 as noted in FIG. 10, this interconnects two of the ergonomic pillow assemblies 12 so that two of the relaxing person's 14 can utilize the same relaxing structure concurrently.

The dual ergonomic pillow assembly 110 can be provided with four of the stereo speaker members 90, each mounted within a respective speaker resonating chamber 45, and having the audio transmitter assembly 40 connected thereto and operable as described above for the single ergonomic pillow assembly 12.

In this case, each relaxing person 14 can control its own volume through the integrated on/off and volume switch 98 and the stereo balance control 102 to receive the desired input from the audio source member 92 which can be a radio/clock, CD player, tape recorder, or the like.

The ergonomic pillow assembly and dual ergonomic pillow assembly of this invention are economical to manufacture; operable to be custom designed and constructed; to fit a person's should width and spinal length; easy to use; operable to provide soothing audio input from numerous audio sources; and substantially maintenance free.

While the invention has been described in conjunction with preferred specific embodiments thereof, it will be understood that this description is intended to illustrate and not to limit the scope of the invention, which is defined by the following claims:

We claim:

1. An ergonomic pillow assembly operable to receive and support a person's head having a skull section connected to a neck portion, spinal assembly, lumbar, and waist area thereon, comprising:

a) a head support assembly to receive and support a person's skull section and neck portion connected to a thoracic support assembly which, in turn, is connected to a waist and lumbar support assembly;

b) said head support assembly and said waist and lumbar support assembly extended laterally of said thoracic support assembly; and c) said thoracic support assembly includes a shoulder cut-out retainer area between said head support assembly and said waist and lumbar support assembly operable to receive the person's shoulder therein when resting on the person's side.

2. An ergonomic pillow assembly as described in claim 1, wherein:

a) said head support assembly includes a head support member having an arcuate upper surface to receive a person's head resting thereon and including a side cervical support member; and b) said side cervical support member includes a neck support section integral with an arcuate jaw support section to receive the person's neck and jaw thereagainst when resting on the person's side.

3. An ergonomic pillow assembly as described in claim 1, wherein:

a) said thoracic support assembly is secured to a central portion of said head support assembly and a central portion of said waist and lumbar support assembly having one of said shoulder cut-out retainer areas on both sides of said thoracic support assembly to receive the person's shoulder therein, respectively, when resting on either the person's left or right side.

4. An ergonomic pillow assembly as described in claim 1, wherein:

a) said head support assembly having a side cervical support member thereon provided with a neck support section and a jaw support section positioned adjacent said shoulder cut-out retainer area to receive and support the person's neck and jaw areas therein.

5. An ergonomic pillow assembly as described in claim 1, including:

a) said head support assembly having mounted therein a speaker resonating chamber;

b) an audio transmitter assembly having a speaker member mounted within said speaker resonating chamber and connected to an audio source and an audio control assembly;

c) said audio source connected to a power source to provide enjoyable sounds therefrom and connected to said audio control assembly which, in turn, is connected to said speaker member to achieve audio output therefrom; and d) said audio control assembly having a timer and clock and volume control for the selective use of the person utilizing the ergonomic pillow assembly.

6. An ergonomic pillow assembly operable to receive and support a person's head, spinal assembly, lumbar, and waist area thereon, comprising:

a) a head support assembly having a side cervical support member operable to receive and support the person's face and jaw when resting on the person's side;

b) said head support assembly connected to a thoracic support assembly which slopes downwardly and outwardly from said head support assembly;

c) a waist and lumbar support assembly connected to said thoracic support assembly which slopes outwardly and laterally therefrom; and d) said thoracic support assembly includes a shoulder cut-out retainer area between said head support assembly and said waist and lumbar support assembly operable to receive the person's shoulder therein when resting on the person's side.

7. An ergonomic pillow assembly as described in claim 6, wherein:

a) said thoracic support assembly includes a main thoracic support member having one of said shoulder cut-out retainer area on both sides thereon to receive the person's shoulder therein when resting on either the person's left or right side.

8. An ergonomic pillow assembly as described in claim 6, wherein:

a) said head support assembly is provided with a pair of spaced ones of said side cervical support members positioned adjacent and laterally of said thoracic support assembly and adjacent said shoulder cut-out retainer area; and b) said side cervical support member having a neck support section integral with an arcuate jaw support section having an arcuate jaw support surface and said arcuate upper surface to provide support through said arcuate jaw support surface and said jaw support section to the person's head utilizing same.

9. An ergonomic pillow assembly as described in claim 6, wherein:

a) said head support assembly includes a head support member having a pair of outer head retainer sections curved upwardly to achieve a means for preventing the person utilizing same from rolling its head off said head support assembly.

10. An ergonomic pillow assembly as described in claim 6, wherein:

a) said waist support assembly includes a waist support member integral with a lumbar support member; and b) said thoracic support assembly includes a thoracic cage retainer member having an outer, arcuate, upwardly retainer surface to keep the person utilizing same from rolling off said waist and lumbar support assembly area.

11. An ergonomic pillow assembly as described in claim 6, wherein:

a) said head support assembly having a speaker resonating chamber on opposite sides thereof;

b) an audio transmitter assembly having stereo speaker members mounted in respective ones of said speaker resonating chambers and operably connected to an audio control assembly which, in turn, is operably connected to an audio source; and c) said audio source provides audio signals therefrom as connected to a power source and sends power signals to the audio control assembly which, in turn, transfers the audio signals to said stereo speaker members.

12. An ergonomic pillow assembly as described in claim 6, wherein:

a) said head support assembly having a head support member with an arcuate upper surface extended in a concave curve from a back wall to its connection to said thoracic support assembly;

b) said thoracic support assembly from its connection to said head support assembly extends in an arcuate concave curve downwardly towards its junction with said waist and lumbar support assembly which curves upwardly to form an elongated concave curve to receive the neck area and lumbar area of the person's body to be rested thereon; and c) said waist and lumbar support assembly extends from its connection to said thoracic support assembly upwardly and then downwardly to present a convex curve thereon to support lumbar and waist areas of the person utilizing same.

13. An ergonomic pillow assembly as described in claim 6, wherein:

a) an upper surface of said head support assembly, said thoracic support assembly, and said waist and lumbar support assembly is of a generally sloping S-shape conforming to the normal curvature of the person's spinal assembly to provide maximum support thereto while holding in a natural, unstrained condition.

14. A dual ergonomic pillow assembly to be supported on an upper bed mattress surface and operable to be used by two (2) persons to receive and support their respective head, spinal assembly, lumbar, and waist area thereon, comprising:

a) a pair of ergonomic pillow assemblies interconnected by a central support section;

b) each of said ergonomic pillow assemblies includes a head support assembly connected to a thoracic support assembly which, in turn, is connected to a waist and lumbar support assembly; and c) respective ones of said thoracic support assemblies having adjacent ones of said head support assembly and said waist and lumbar support assembly extended laterally therefrom and forming a shoulder cut-out retainer area therebetween;

whereby said shoulder cut-out retainer area is operable to receive a person's shoulder therein when resting on the person's side.

15. A dual ergonomic pillow assembly as described in claim 14, wherein:

a) each of said head support assemblies having a side cervical support member positioned adjacent said shoulder cut-out retainer areas and operable to receive a portion of the person's face, neck, and jaw areas for support thereon when the person is resting on the person's left or right side with the person's shoulder within said shoulder cut-out retainer area.

16. A dual ergonomic pillow assembly as described in claim 15, wherein:

a) said head support assembly having a pair of spaced speaker resonating chambers on respective opposite sides of respective ones of said thoracic support assemblies;

b) an audio transmitter assembly having an audio source connected to a power source to transmit audio signals therefrom;

c) a pair of stereo members for each of said ergonomic pillow assemblies connected to said audio source through an audio control assembly; and d) said audio control assembly having independent volume controls so that each set of said stereo speaker members utilized on a different person on a spaced pair of said ergonomic pillow assemblies can control the audio volume and time of operations through said audio control assembly.

17. A dual ergonomic pillow assembly as described in claim 15, wherein:

a) said side cervical support members on adjacent ones of said pair of said ergonomic pillow assemblies being removed as well as inner ones of an arcuate upwardly retainer surface of a thoracic cage retainer member of said thoracic support assembly to allow commingling of the people utilizing the dual ergonomic pillow assembly of this invention.

18. An ergonomic pillow assembly being custom designed for a person having a predetermined shoulder width, such as 20 inches, hereinafter referred to as SW, and a spinal length, such as 30 inches, hereinafter referred to as SL, and operable to support the person's head, spinal assembly, lumbar, and waist area thereon, comprising:

a) a head support assembly;

b) a thoracic support assembly having one end connected to a center portion of said head support assembly and extended laterally therefrom;

c) a waist and lumbar support assembly connected to another end of said thoracic support assembly and extended laterally therefrom;

d) said head support assembly and said waist and lumbar support assembly having a width of 1.2 SW±10 percent;

e) said thoracic support assembly having a width of 0.4 SW±10 percent; and f) said ergonomic pillow assembly having a length of 1.07 SL±10 percent.

19. An ergonomic pillow assembly as described in claim 18, wherein:

a) said head support assembly having a height at a center of a concave curve equal to 0.25 SW±10 percent;

b) said thoracic support assembly having a concave curve leading from said head support assembly to said waist and lumbar support assembly having a height of 0.3 SW sloping downwardly to a minimum height of 0.06 SW±10 percent which then curves upwardly and outwardly to an outer maximum height of 0.1 SW±10 percent thereby forming a concave curve conforming to the curvature of a person's spinal assembly in the lumbar area to provide necessary and desired support thereto.

20. An ergonomic pillow assembly as described in claim 18, wherein:

a) said head support assembly includes a head support section having an arcuate upper head support section with an arcuate upper support surface having a width thereof equal to 0.2 SL±10 percent.

21. An ergonomic pillow assembly as described in claim 20, wherein:

a) said head support member includes a head retainer section extended at outer lateral areas to retain the person's head from rolling off therefrom without affording resistance to such movement.

22. An ergonomic pillow assembly operable to receive and support a person's head having a skull section connected to a neck portion, spinal assembly, lumbar, and waist area thereon, comprising:

a) a head support assembly to receive and support a person's skull section and neck portion connected to a thoracic support assembly which, in turn, is connected to a waist and lumbar support assembly; and b) said thoracic support assembly includes a shoulder cut-out retainer area between said head support assembly and said waist and lumbar support assembly operable to receive the person's shoulder therein when resting on the person's side.

* * * * *

UNITED STATES PATENT AND TRADEMARK OFFICE

CERTIFICATE OF CORRECTION

PATENT NO. : 5,479,667

DATED : JANUARY 2, 1996

INVENTOR(S) : FRANK O. NELSON AND KATHY L. NELSON

It is certified that error appears in the above-indentified patent and that said Letters Patent is hereby corrected as shown below:

In the Drawings:

Delete Figures 3-6, and substitute therefor the Drawings Sheet, consisting of Figure 3-6, as shown on the attached page.

Signed and Sealed this

Fourth Day of February, 1997

*Attest:*

Bruce Lehman

BRUCE LEHMAN

*Attesting Officer*

*Commissioner of Patents and Trademarks*